US005394648A

United States Patent [19]

Kordes

[11] Patent Number: 5,394,648

[45] Date of Patent: Mar. 7, 1995

[54] PANEL WITH A UNIT FOR SWINGING AND SLIDING THE PANEL

[75] Inventor: Herbert Kordes, Bad Salzuflen, Germany

[73] Assignee: Dorma GmbH+Co. KG, Ennepetal, Germany

[21] Appl. No.: 74,791

[22] Filed: Jun. 10, 1993

[30] Foreign Application Priority Data

Oct. 11, 1991 [DE] Germany ..... 4133720

[51] Int. Cl.[6] ..... E05D 15/22

[52] U.S. Cl. ..... 49/177; 49/183

[58] Field of Search ..... 49/177, 176, 178, 180, 49/183, 184, 185, 159, 158, 160

[56] References Cited

U.S. PATENT DOCUMENTS

| | | | |
|---|---|---|---|
| 1,085,065 | 1/1914 | Speicher | 49/183 X |
| 3,291,192 | 12/1966 | Jones, Jr. | 49/177 X |
| 3,466,805 | 9/1969 | Muessel | 49/177 X |
| 4,438,594 | 3/1984 | Bunzl | 49/177 |
| 4,752,987 | 6/1988 | Dreyer et al. . | |
| 4,888,915 | 12/1989 | Goldenberg | 49/177 X |

FOREIGN PATENT DOCUMENTS

| | | |
|---|---|---|
| 0340795 | 11/1989 | European Pat. Off. . |
| 3148464 | 12/1982 | Germany . |
| 3522824 | 8/1986 | Germany . |
| 226264 | 12/1924 | United Kingdom . |
| 2154654 | 9/1985 | United Kingdom . |

*Primary Examiner*—Philip C. Kannan
*Attorney, Agent, or Firm*—Nils H. Ljungman & Associates

[57] ABSTRACT

A panel, such as a door or wall partition, with a unit for swinging and sliding the panel. Particularly, a fixing and locking unit which is located in a housing, and can be retrofitted on all existing door systems. By means of a fixing screw and a locking screw which can be operated from the floor by means of a tool, the door can either be released or blocked in its sliding or its swinging direction.

1 Claim, 5 Drawing Sheets

PANEL WITH A UNIT FOR SWINGING AND SLIDING THE PANEL

CONTINUING APPLICATION DATA

This application is a continuation-in-part application of International Application No. PCT/DE92/000828, filed on Sep. 23, 1992, which claims priority from Federal Republic of Germany Patent Application No. P 41 33 720.4, filed on Oct. 11, 1991. International Application No. PCT/DE92/00828 was pending as of the filing date of U.S. application Ser. No. 08/074,791 and the U.S. was an elected state in International Application No. PCT/DE92/00828.

BACKGROUND OF THE INVENTION

1. Field of the Invention:

This invention generally relates to a panel with a unit for swinging and sliding the same. Such a panel may, for example, be in the form of a door or a wall partition.

More particularly, the present invention relates to a fixing and locking unit like those used preferably for mobile door and wall elements. The system thereby consists of stationary ceiling-mounted rails with corresponding rail junctions, which make it possible to slide parts or all of the unit located under them or to park them in a side position. This occurs when, for example, a room is to be partitioned off, or one large room is to be divided into several smaller rooms. An additional area of application, one which is increasing in importance, is door-wall elements in restaurants and retail stores. Here, depending on the weather conditions, the entire front window can be removed, or only parts of the entire front window system can be moved.

2. Background Information:

Systems of the type described above are disclosed in German Pat. No. 35 22 824 (which corresponds to U.S. Pat. No. 4,752,987) and German Patent No. 31 48 464. But to be able to modify these systems quickly and without major effort, the door and wall elements are equipped with what are called catches, located on the upper end of an element, which can be released or fixed by removing or inserting a lock. However, this system can be troublesome in systems more than 2 meters high measured from the floor, because not everyone can reach this lock without using ladders or similar devices. Moreover, located next to the lock is a hook lock, which must usually be engaged with a locking piston. This lock tends to have a very complex design, and tends to require complex, expensive and time-consuming milling operations to insert it into the door rail.

Nor is this lock usually altogether easy to handle, since as a rule this lock also tends to be located on the upper end of the door panel.

It can therefore be said that the systems currently on the market are generally not very user-friendly, and can also represent a high potential for accidents, since auxiliary equipment, such as ladders, must usually be used to operate them. These catches and locks are also usually very expensive to manufacture.

OBJECT OF THE INVENTION

The object of the invention is to create a fixing and locking unit whose two functions, namely swinging and sliding, are combined in a single unit. Moreover, it should be possible to operate the device easily and successfully, and it should be possible to install it on existing doors, with no limitation to very specific types of doors. Also, from a manufacturing point of view, an additional object of the invention is to create an economical fixing and locking unit.

SUMMARY OF THE INVENTION

This object is achieved by a fixing and locking unit which preferably includes a top part, a middle part and a bottom part, which are located one under the other. These three parts of the unit are preferably attached externally to the door system by means of bolt-type arrangements, such as screws. Inside the unit, there is preferably one screw for each of the fixing process and for the locking process. These screws can preferably be operated by an individual standing on the floor, by means of an articulated crank which has a hexagon socket head wrench on its upper end. By means of such a hexagon socket head wrench, both the fixing screws and the locking screws can preferably be tightened or loosened.

If it is assumed, for example, that the door is closed, the fixing screw, which can preferably be located in the middle part of the unit, is preferably screwed by means of a rotational movement into the top part of the unit located above it and fastened to the runner rail. Thus, part of the unit, namely the top and middle parts, can be connected together, and the panels can essentially no longer slide laterally. So that the swinging position can also be secured, the second locking screw, which can preferably be located in the bottom part of the unit, is preferably screwed into the middle part of the unit. By means of this type of screwed connection, the entire door is essentially fixed in place, and the top, middle and bottom parts form a unit.

If the door panel as a whole is now to be placed in a parked, or rest, position, the fixing connection should preferably be removed so that the entire panel can slide inside the runner rail. If, however, the door is to swing only, the fixing screw should preferably remain connected to the runner rail, and the locking screw should preferably be unscrewed from the middle part so that the door is no longer fixed in its swinging movement. As a result of the use of an articulated crank, the danger involved in adjusting the locking and fixing is practically eliminated, because essentially no additional devices need to be used.

On account of the type of design described above, the inventive activity results in a fixing and locking unit which can be installed without major modifications even on existing door systems. As explained in greater detail below with reference to one embodiment, the entire unit is preferably connected to the door system by means of six connecting screws. Essentially, this is a rapid type of installation, and the unit can thus be installed even on existing door systems without complex, expensive and time consuming milling operations. Nor does the manufacture of this fixing and locking unit tend to involve any complex, expensive or time-consuming manufacturing processes.

In summary, one feature of the invention resides broadly in a wall partition for being mounted between an upper support area, such as a ceiling, and a lower support area, such as a floor, the wall partition comprising: partition means; means for supporting the partition means between the upper support area and the lower support area; locking means for selectively locking and unlocking at least one of sliding movement and swinging movement of the partition means; the locking means comprising a singular unit being mounted on an external surface of the wall partition; the locking means comprising: first bolt means for selectively locking and unlocking the sliding movement of the partition means; second bolt means, separate from the first bolt means, for selectively locking and unlocking the swinging movement of the partition means.

Another feature of the invention resides broadly in a door for being mounted between an upper support area and a lower support area, the door comprising: a door member; means for supporting the door member between the upper support area and the lower support area; locking means for selectively locking and unlocking at least one of sliding movement and swinging movement of the door member; the locking means comprising a singular unit being mounted on an external surface of the door; the locking means comprising: first bolt means for selectively locking and unlocking the sliding movement of the door member; second bolt means, separate from the first bolt means, for selectively locking and unlocking the swinging movement of the door member; the first bolt means being selectively positionable between a first position and a second position different from the first position; the first bolt means being configured to: prevent sliding movement of the door member when the first bolt means is in the first position; and permit sliding movement of the door member when the first bolt means is in the second position; the second bolt means being selectively positionable between a first position and a second position different from the first position; the second bolt means being configured to: prevent swinging movement of the door member when the second bolt means is in the first position; and permit swinging movement of the door member when the second bolt means is in the second position.

Yet another feature of the invention resides broadly in a method of adjusting a panel in a panel arrangement, such as a wall partition or door, the panel arrangement for being mounted between an upper support area and a lower support area, the method comprising the steps of: providing a panel; providing means for supporting the panel between the upper support area and the lower support area; supporting the panel between the upper support area and the lower support area; providing locking means for selectively locking and unlocking at least one of sliding movement and swinging movement of the panel; configuring the locking means to comprise a singular unit; mounting the locking means on an external surface of the panel member; configuring the locking means to comprise: first bolt means for selectively locking and unlocking the sliding movement of the panel; and second bolt means, separate from the first bolt means, for selectively locking and unlocking the swinging movement of the panel; the method further comprising the additional steps of: locking, by means of the first bolt means, the swinging movement of the panel; unlocking, by means of the second bolt means, the sliding movement of the panel; effecting a sliding movement of the panel; locking, by means of the second bolt means, the sliding movement of the panel; unlocking, by means of the first bolt means, the swinging movement of the panel; and effecting a swinging movement of the panel.

BRIEF DESCRIPTION OF THE DRAWINGS

The invention is explained below in greater detail with reference to one possible embodiment which is schematically illustrated the accompanying drawings, wherein.

DESCRIPTION OF THE PREFERRED EMBODIMENTS

Figure 1:
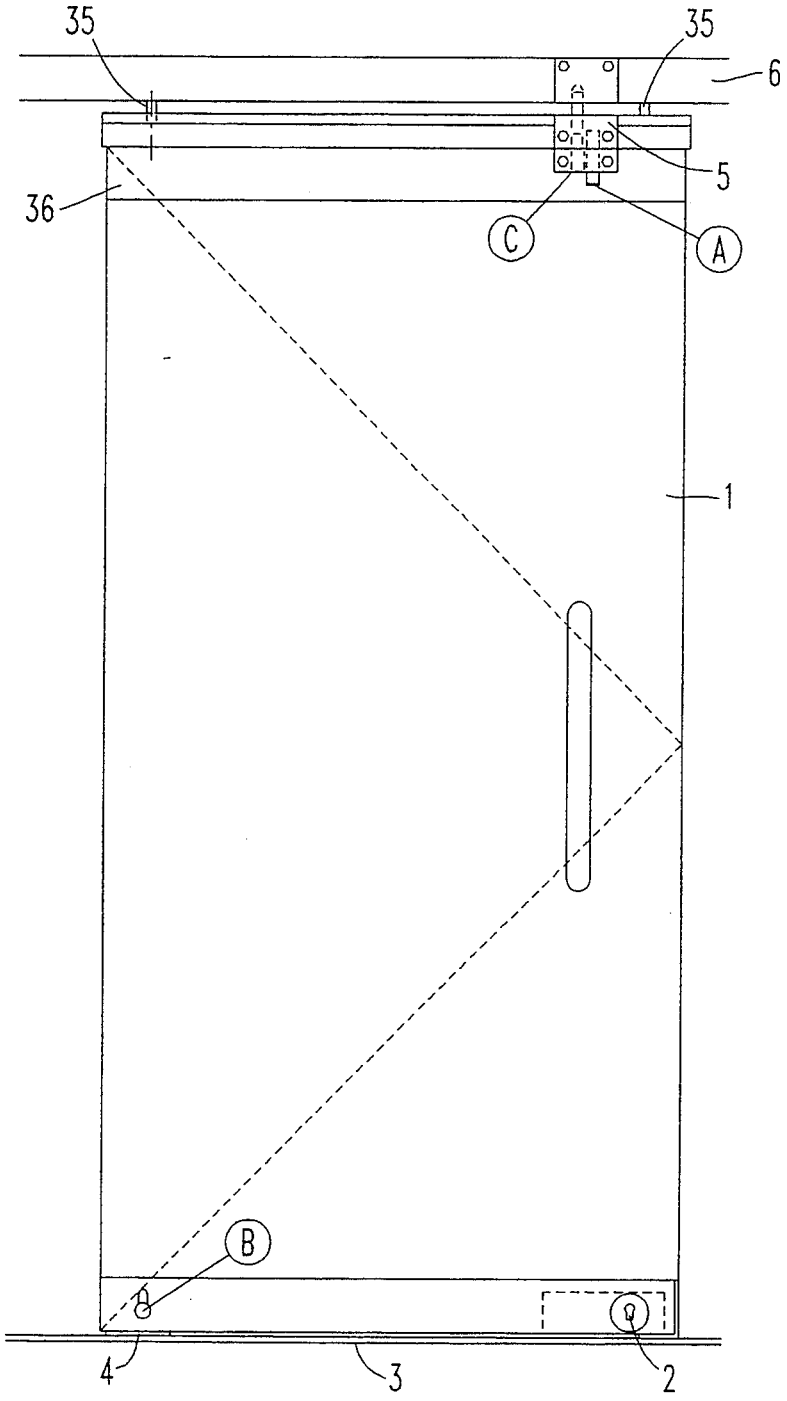
FIG. 1 shows an entire door with the fixing and locking unit.

FIG. 1 shows an entire door to which a fixing and locking unit has been attached. If this unit is to be used as a sliding door, for example, the following manual interventions should preferably be undertaken:

A. The locking screw 24 should preferably be tightened, so that the door can no longer swing.

B. The floor lock 4 should preferably be extracted, so that the door is also free in the floor area.

C. The fixing screw 19 should preferably be loosened by means of an articulated crank, so that the connection between the door and the runner rail 6 fastened to the ceiling is released. On account of this position of the screws, the door can essentially slide by means of the suspensions 35 in the runner rail.

But if this door is no longer to slide, the manual interventions indicated above should preferably be reversed accordingly, as follows:

C. The fixing screw 19 should preferably be returned to its locked position with the runner rail 6.

B. Then the floor lock 4 can preferably be locked once again, and, in a third step (A), the locking screw 24 can preferably be unscrewed.

In this position, the door can swing to both sides, unless a door closer has been installed, or there is a stop 7 in the upper region, as shown, which allows the door to swing in only one direction. There can also be a lock 2 installed in the door near the floor, so that the entire door can be closed, or locked.

Thus, in accordance with a preferred embodiment of the present invention, a fixing and locking unit 5 may preferably be mounted on an external surface of a door 1 or similar structure, such as a wall partition. In a manner which will be more fully understood hereinbelow, fixing and locking unit 5 is preferably in the form of a single unit and is preferably configured to selectively permit the locking and unlocking of sliding and/or swinging movement of the door 1.

Typically, door 1 is supported between an upper support area 6 and a lower support area 3. Upper support area 6 may be constituted, for example, by a runner rail or other track area. A runner rail 6, for example, may preferably be mounted on a ceiling. Door 1 may preferably be suspended from the upper support area 6 by suspensions 35. At a lower area of the door 1, a floor lock 4 may be provided to selectively lock and unlock the door 1 at that area. Another lock 2 may also be provided at another portion of the lower area of the door.

Figure 1A:
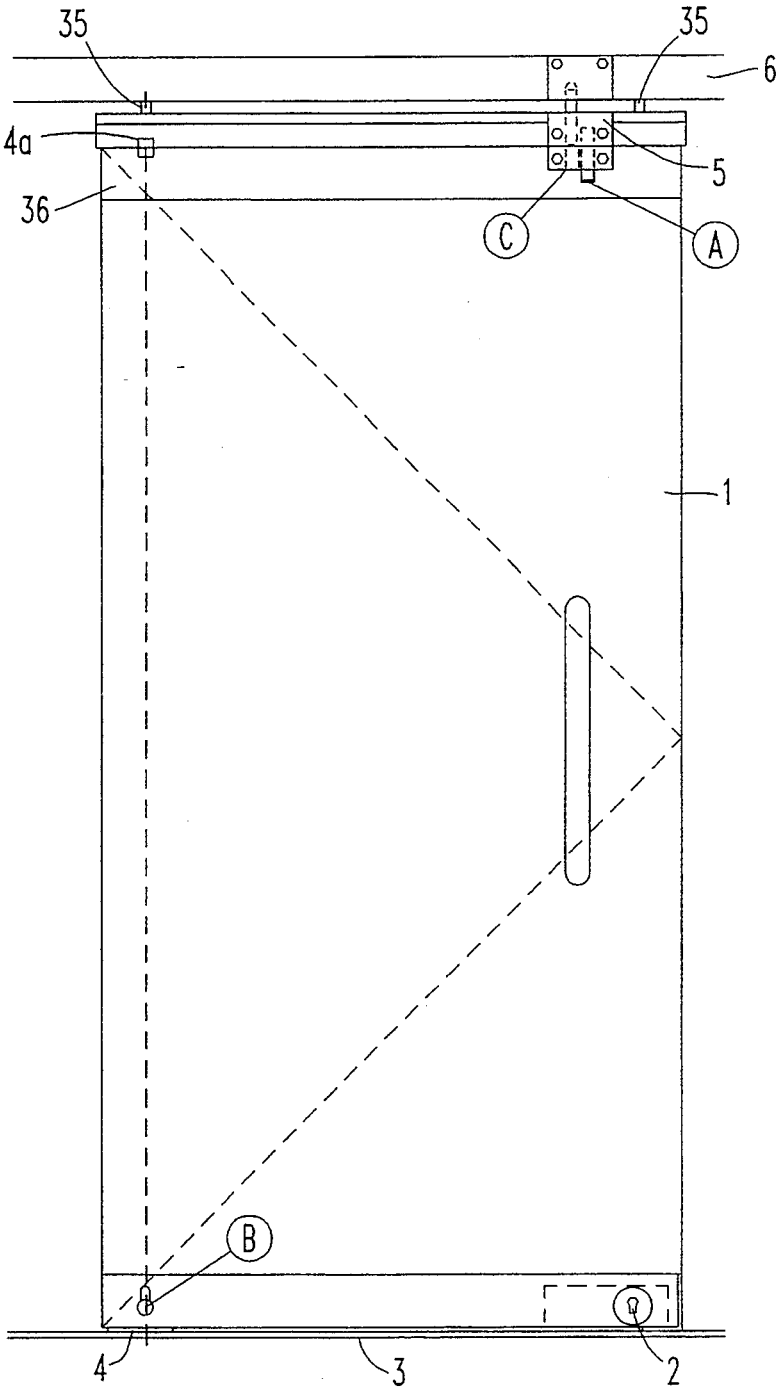
FIG. 1*a* is essentially the same view as FIG. 1, with additional components referenced.

With reference to FIG. 1*a*, in a preferred embodiment of the present invention, floor lock 4 may preferably be configured to assist in providing a hinging function for the swinging movement of door 1. To this end, floor lock 4 may preferably be in the form of a slidable bolt or the like. Preferably, an appropriate hinge arrangement 4*a* is provided at an upper portion of door 1. Thus, floor lock 4 may preferably be configured such that, when the sliding movement of door 1 is locked, floor lock 4 may be extended downwardly into an appropriate receptacle in order to be able to supplement hinge arrangement 4*a* in providing a hinging function for the swinging movement of door 1. Conversely, if floor lock 4 is retracted upwardly, it is then essentially possible for the door 1 to assume a sliding function providing, of course, that other appropriate steps are taken.

In accordance with the present invention, fixing and locking unit 5 may preferably be mounted at an upper portion of door 1. Two screws, namely a locking screw 24 and fixing screw 19 are preferably provided to selectively lock and unlock the sliding and swinging movement of door 1. Of course, screws 19 and 24 may also be embodied by a similar structure, such as a bolt.

In a manner to be described more fully below, locking screw 24 is preferably configured to selectively lock and unlock swinging movement of the door 1. Additionally, fixing screw 19 is preferably configured to selectively lock and unlock sliding movement of the door 1. Preferably, in order to lock and unlock sliding movement of door 1, fixing screw 19, as wall as locking screw 24, can be adjustable by means of an articulated crank.

Thus, for example, to render the door 1 slidable the locking screw 24 may preferably be tightened to lock the swinging movement of the door. Thence, appropriate other locks, such as floor lock 4, may also be loosened, if such locks are not already released as such. Fixing screw 19 can then be loosened by means of an articulated crank to release the connection between the door 1 and the runner rail 6. Door 1 should thence preferably be able to slide with respect to rail 6.

To once again lock the sliding movement of door 1, fixing screw 19 may preferably be tightened so as to effect connection between door 1 and rail 6. Floor lock 4, or a similar lock, may then be re-locked and locking screw 24 may thence preferably be loosened.

With fixing screw 19 and locking screw 24 thus positioned, door 6 will essentially be capable of undergoing a swinging movement.

Figure 2:
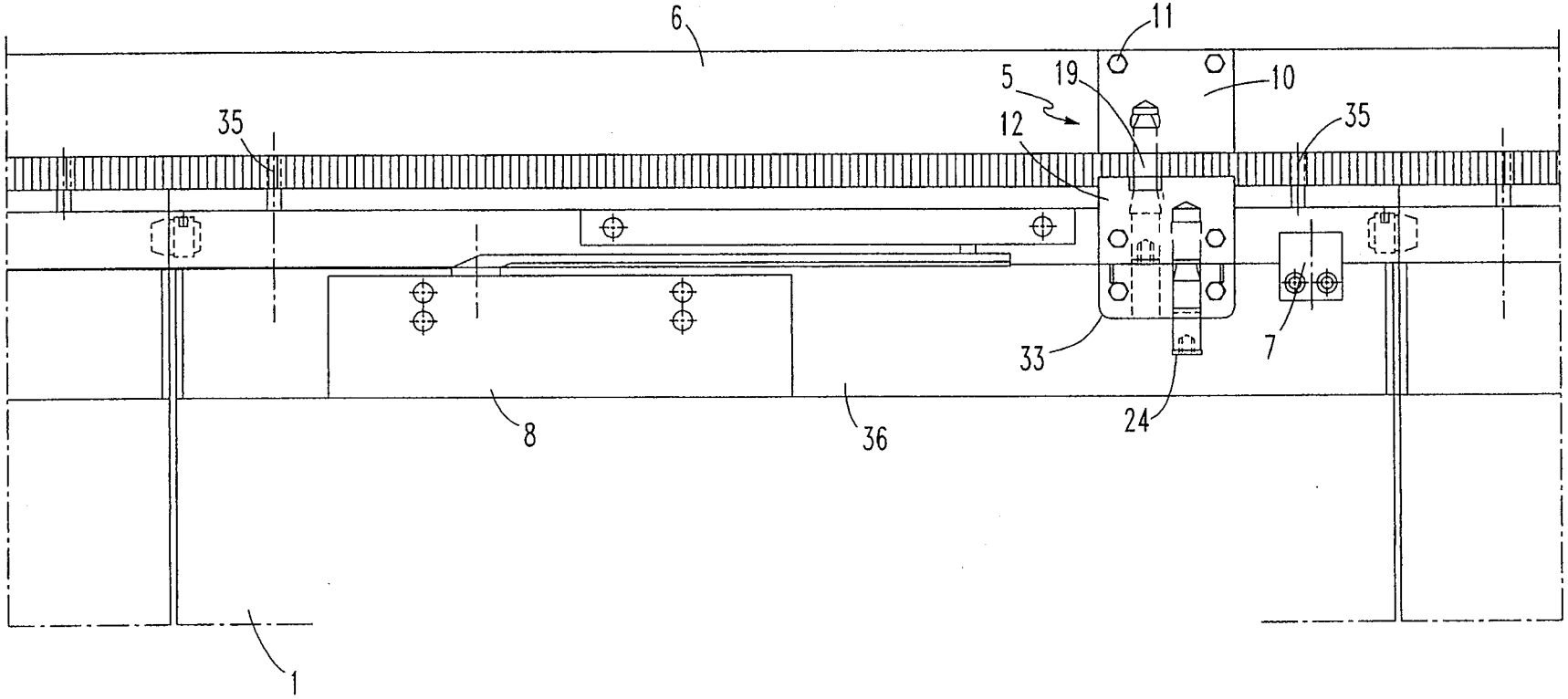
FIG. 2 shows a fixing and locking unit in connection with a door closer.

FIG. 2 shows a detail of an entire system, in which several door elements or wall elements are indicated schematically. These door and wall elements can preferably be designed either as all-glass or as framed elements.

The fixing and locking unit 5 is shown here in a position in which the fixing screw 19 is connected by means of the middle part 12 with the top part 10. This figure shows how the top part 10 is connected to the runner rail 6 by means of the connections 11, so that the door 1 can no longer slide.

On the other hand, the locking screw 24 is shown in a position in which it is located essentially only in the bottom part 33 of the fixing and locking unit 5. The door 1 is thereby essentially not hindered in its swinging movement. But this swinging movement is limited on one side by the stop 7, which allows the door to swing only in one direction. In this embodiment, there is also a door closer 8, which is also preferably located on the cover plate 36 of the door panel 1, to which the bottom part 33 of the fixing and locking unit 5 may preferably be attached.

Thus, as shown in FIG. 2, a fixing and locking unit 5 according to the present invention may preferably be embodied by three parts, or sections, namely, a top part 10, middle part 12 and lower or bottom part 33. Fixing screw 19 is preferably configured to extend between top part 10 and middle part 12, or to reside solely in one of top part 10 and middle part 12, preferably in middle part 12. Likewise, locking screw 24 is preferably configured to extend between lower part 33 and middle part 12, or to reside solely in middle part 12 or lower part 33, preferably in lower part 33. Thus, each of fixing screw 19 and locking screw 24 is preferably adjustable so as to either reside solely in one of upper part 10, middle part 12 or lower part 33, or to connect two adjacent parts.

Preferably, upper part 10 is mounted at or on runner rail 6. Thus, in extending between middle part 12 and upper part 10, fixing screw 19 can prevent sliding movement of door 1. Likewise, in a manner which will be understood more fully below, in extending between lower part 33 and middle part 12, locking screw 24 can prevent swinging movement of door 1.

Figure 3:
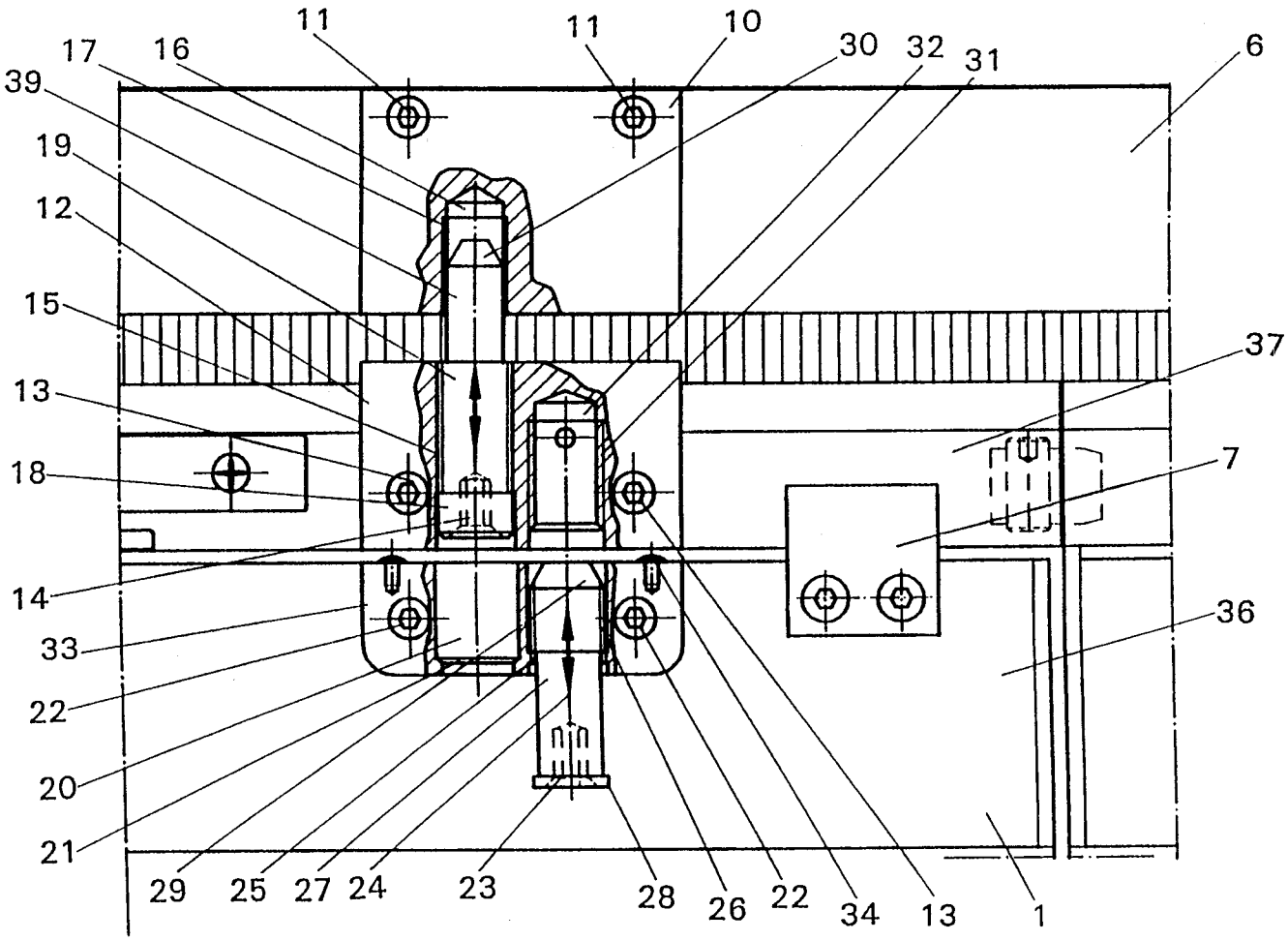
FIG. 3 shows a fixing and locking unit, in partial cross section, installed on a door.

FIG. 3 shows a comprehensive view, with the fixing and locking unit in partial cross section. The top part of the fixing and locking unit 5 is preferably connected by means of the runner rail fasteners 11 to the runner rail 6 fastened to the ceiling or to the stationary frame of the entire system. The fixing screw 19 is preferably screwed by means of the thread 15 in the middle part 12 so that a cylindrical shaft 39 is extended into a bushing 17 of a blind hole 16 of the top part 10. To facilitate the turning of this screw, and to compensate for the manufacturing tolerances of the entire system, the fixing screw 19 is preferably equipped with a conical lead 30. This conical lead 30 can preferably make possible an easier and more secure introduction of the fixing screw 19 into the bushing 17 of the blind hole 16. In the position illustrated, the door 1 cannot slide, since by means of the fixing screw 19, the door is connected to the stationary part of the runner rail 6 via the top part 10 of the fixing and locking unit 5.

If, by means of the hexagon socket head 14 of the fixing screw 19, the fixing screw 19 is now unscrewed from the thread 15 by means of the articulated crank (not shown), which preferably has a hexagon socket head wrench on its end, the door 1 would be released so that it could slide. To prevent the fixing screw 19 from falling out of the hole, there is preferably a stop 21 in the bottom part 33 of the fixing and locking unit 5. This stop 21 essentially makes the fixing screw 19 captive. An aligned hole preferably leads through all three parts of the fixing and locking unit 5, namely the bottom part 33, the middle part 12 and the top part 10, and the fixing screw 19 can preferably be inserted into this hole at a vertically adjustable level. The middle part 12 can preferably be connected by means of the connections between the fastener 13 and carrier profile 37. The bottom part 33 is preferably located in alignment below the middle part 12. The bottom part 33 is preferably connected by means of the frame fastener 22 to the cover plate 36, which is preferably located on the door panel 1 of the preferably all-glass door. In addition to the fixing screw 19, there is preferably an additional adjustable screw, namely the locking screw 24 in the fixing and locking unit 5. Parallel to the hole 20 for the fixing screw 19, an additional hole 32 has preferably been introduced in the middle part 12. This hole 32 in the middle part is preferably a blind hole, but the beginning of this hole is preferably aligned with with the hole 38 in the bottom part 33 beneath it. The hole 32 preferably has an internal screw thread 31 in its rear portion. The locking screw 24 with its external screw thread 26 can preferably be screwed into this internal screw thread 31, to prevent the swinging movement of the door. This locking screw 24 also preferably has a conical lead 29 on its initial portion, which also preferably guarantees a secure introduction into the blind hole 32. But the locking screw 24, in its rear portion toward the stop head 28, preferably has an undercutting, or reentrant angle 27 of the thread 26, which essentially makes it easier to screw in. The locking screw 24, by means of the internal hex socket 23 in its head, and the hand crank with the hexagon socket head wrench fastened to it, is preferably screwed into the middle part 12. The stop is preferably formed by the stop head 28, which preferably extends into the bottom part 33. As a result of this connection of the middle part 12 to the bottom part 33, the door is prevented from swinging. When all three individual parts of the fixing and locking unit 5 are connected to one another by means of the fixing screw 19 and the locking screw 24, the door can no longer slide. It is thereby guaranteed that the door has been fixed and locked in position, simultaneously and in a simple manner.

Thus, in accordance with a preferred embodiment of the present invention, top part 10 of fixing and locking unit 5 is preferably connected by means of runner rail fasteners 11 to runner rail 6, which runner rail 6 may be fastened to a ceiling or other frame. Middle part 12 preferably includes an internal thread 15 for threadedly accommodating therewithin fixing screw 19. A cylindrical shaft portion 39 of fixing screw 19 is preferably slidably, or even threadedly, accommodated in a cylindrical bushing 17 of upper part 10. Cylindrical bushing 17 may be accommodated in a blind hole 16 of upper part 10. Fixing screw 19, at an upper end thereof, preferably includes a conical lead 30, as shown. Essentially, conical lead 30 is preferably configured to facilitate the introduction of fixing screw 19 into bushing 17 of blind hole 16. In the positioning illustrated in FIG. 3, fixing screw 19 extends between middle part 12 and upper part 10. Because upper part 10 is fixed with respect to a stationary part of runner rail 6, the door 1 cannot slide.

An articulated crank (not shown), possibly with a hexagonal head, may preferably be employed to adjust fixing screw 19. To this end, a lower end of fixing screw 19 is preferably provided with a hexagonal socket head 14.

To release the lock on sliding movement provided by fixing screw 19, preferably, fixing screw 19 is unscrewed from thread 15 and is retracted completely away from upper part 10. It should be understood that, preferably, an aligned hole leads through all three parts of the fixing and locking unit 5, namely, through lower part 33, middle part 12 and upper part 10, to ensure that fixing screw 19 can be properly adjusted by means of the appropriate tools.

Likewise, in accordance with a preferred embodiment of the present invention, middle part 10 of fixing and locking unit 5 is preferably connected by means of fasteners 13 to carrier profile 37. Carrier profile 37 is preferably configured to be slidable with respect to runner rail 6 and to itself serve as a frame for the swinging movement of door 6. To the latter end, carrier profile 37 is preferably appropriately hinged. Thus, carrier profile 37 is preferably configured to undergo sliding movement when door 1 undergoes sliding movement but to remain stationary when door 1 undergoes swinging movement. Lower part 33 is preferably connected by means of fasteners 22 to door 1, preferably to a cover plate 36 of door 1. Lower part 33, middle part 12 and upper part 10 are all preferably vertically aligned with one another, as shown, when door 1 is in a rest position.

Another hole 32, parallel to hole 20, is preferably disposed in middle part 12, as shown. Also, lower part 33 preferably includes a hole 38 aligned substantially directly beneath hole 32 of middle part 12. Preferably, hole 32 of middle part 12 is a blind hole and has an internal screw thread 31 in a lower portion thereof. Preferably, locking screw 24 has an external screw thread 26 which can be mated with internal screw thread 31 of hole 32. It should now be understood that, if locking screw 24 is tightened so as to extend between lower part 33 and middle part 12, swinging movement of the door 1 is prevented. Accordingly, if locking screw 24 is completely retracted and is positioned completely separately from middle part 12, then swinging movement of the door 1 is permitted.

Preferably, locking screw 24, at an upper end thereof, includes a conical lead 29, as shown. Similarly, conical lead 29 is preferably configured to facilitate the introduction of locking screw 24 into hole 32. Also, an articulated crank, such as that discussed further above, possibly with a hexagonal head, may preferably be employed to adjust locking screw 24. To this end, a lower end of locking screw 24 is preferably provided with a hexagonal socket head 23. It should be understood that, preferably, an aligned hole leads through lower part 33 and middle part 12 of the fixing and locking unit 5, to ensure that locking screw 24 can be properly adjusted by means of the appropriate tools.

Figure 4:
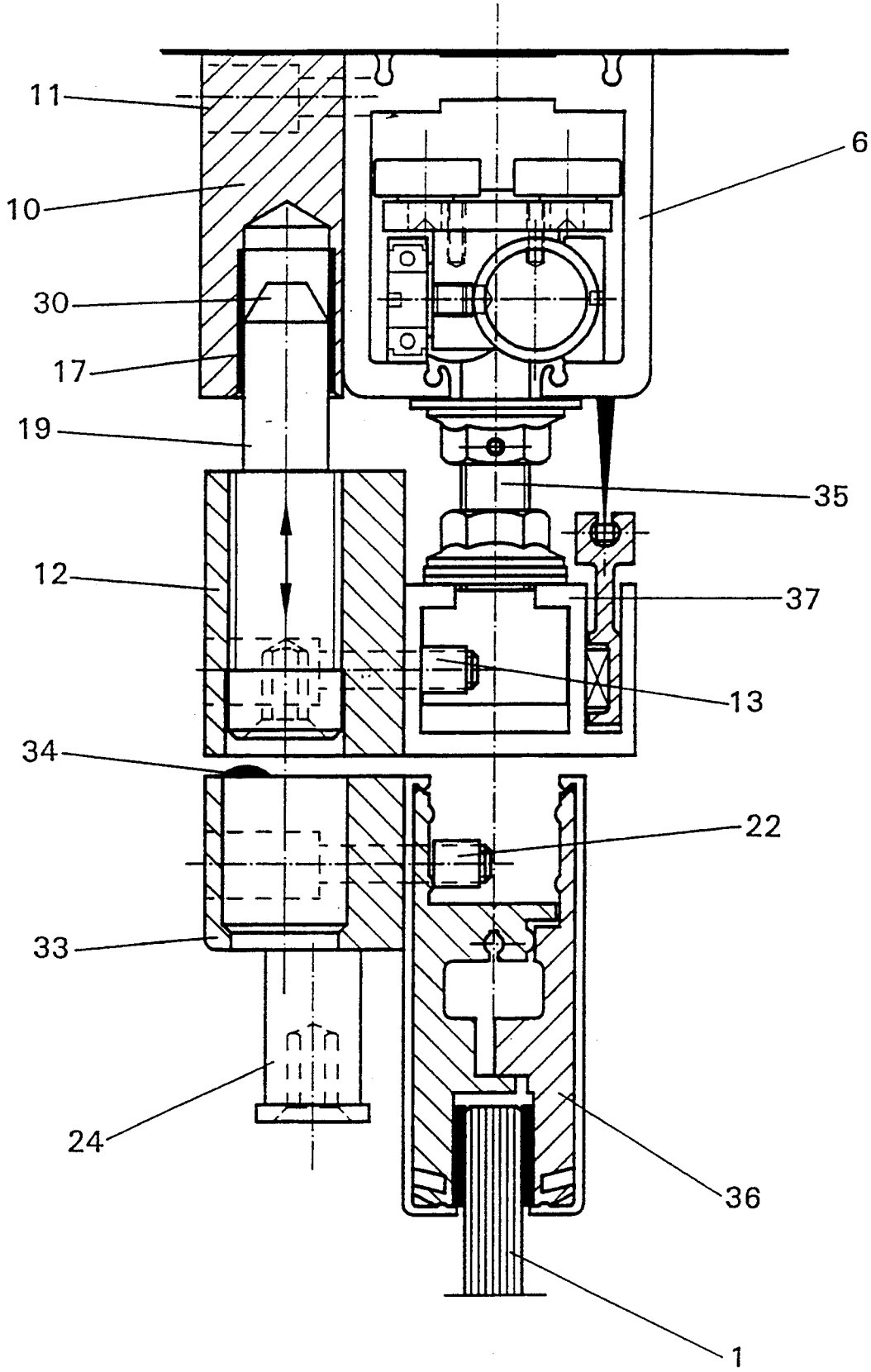
FIG. 4 shows a side view, in cross section, of an installed fixing and locking unit.

FIG. 4, which is a side view in cross section, shows that the parts of the door which are not permanently connected to one another can be securely connected to one another both for the swinging process and for the sliding process by means of the fixing and locking unit 5. There is preferably an adjustable stop 34 between the middle part 12 and the bottom part 33 so that when the locking screw 24 is tightened, the door or the bottom part 33 with the middle part 12 cannot tilt. This stop 34 can preferably be made of plastic, and if appropriate precautions are taken, can compensate for the remaining gap between the middle part 12 and the bottom part 33. FIG. 4 also shows that in the indicated position, the door cannot slide, since the fixing screw 19 has made a connection to the top part 10. By means of the connection to the runner rail fastener 11, the top part 10 is in direct contact with the runner rail 6. Thus the rollers located in the runner rail, with the suspension 35 located beneath them, can no longer execute a sliding movement of the door.

It should be appreciated that, by virtue of adjustable stop 34, the door 1 or bottom part 33 essentially cannot tilt with respect to middle part 12.

The advantage of the invention therefore essentially lies in the fact that the fixing and locking unit can practically be enclosed in a single housing. This significantly simplifies handling operations for the operating personnel, since essentially the same articulated crank can be used for fixing and locking. By means of the articulated crank, which can be purchased in different lengths, the entire system can be reached from the floor, which represents an enormous advantage, particularly if the door height is significantly more than 2 meters high. The entire fixing and locking unit can also essentially be screwed to any type of door system, because essentially only six screw connections need to be made to the existing door or wall system. The fixing and locking unit is preferably made of light alloy or a suitable plastic material.

One feature of the invention resides broadly in the fixing and locking unit for sliding and/or swinging doors and walls, which are movably fastened by means of rollers to/in a runner rail, characterized by the fact that the fixing and locking unit 5 forms a total, single unit consisting of light alloy or plastic, consisting of the top part 10, the middle part 12 and the bottom part 33, whereby the fixing is achieved by means of a fixing screw 19 and the locking by means of a locking screw 24.

Another feature of the invention resides broadly in the fixing and locking unit according to claim 1, characterized by the fact that the top part 10 is positively connected by means of the runner rail fastener 11 to the stationary runner rail 6.

Yet another feature of the invention resides broadly in the fixing and locking unit, characterized by the fact that the middle part 12 is positively connected to the movable carrier profile 37 by means of the fastener 13.

Still another feature of the invention resides broadly in the fixing and locking unit, characterized by the fact that the bottom part 33 is connected to the door panel mount 36 by means of the frame fastener 22.

Still yet another feature of the invention resides broadly in the fixing and locking unit, characterized by the fact that to hold the fixing screw 19, there is an aligned hole 20 in the top part 10, the middle part 12 and accessible from the bottom part 33, whereby the hole 20 has an internal screw thread 15 in the middle part and/or in the top part 10.

Another feature of the invention resides broadly in the fixing and locking unit, characterized by the fact that the fixing screw 19 is prevented from falling out by means of a stop 21.

Still another feature of the invention resides broadly in the fixing and locking unit, characterized by the fact that to hold the locking screw 24, there is an aligned hole 32 in the middle part 12 and which is accessible from the bottom part 33.

Yet another feature of the invention resides broadly in the fixing and locking unit, characterized by the fact that the hole 32 has an internal screw thread 31 in the middle part 12.

Still yet another feature of the invention resides broadly in the fixing and locking unit, characterized by the fact that the locking screw 24 is prevented from becoming unscrewed by means of a stop 25.

Another feature of the invention resides broadly in the fixing and locking unit, characterized by the fact that the locking screw 24 is provided with a thread 26 only in the forward area, and in the rear portion has an undercut 27 for the stop head 28.

Still another feature of the invention resides broadly in the fixing and locking unit, characterized by the fact that the fixing screw 19 and the locking screw 24 have a conical lead 29 and 30.

Yet another feature of the invention resides broadly in the fixing and locking unit, characterized by the fact that the fixing screw 19 and the locking screw 24 are equipped on their head ends with an internal hex socket 14 and 23 which can be fitted to an adjustment tool.

Still yet another feature of the invention resides broadly in the fixing and locking unit, characterized by the fact that there is an adjustable stop 34 between the middle part 12 and the bottom part 33.

Examples of components associated with door structures, which may be utilized in accordance with the embodiments of the present invention, may be found in the following U.S. Pat. Nos. 5,031,274 to Eutebach and 4,752,987 to Dreyer et al.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A wall partition for being mounted between an upper support area, such as a ceiling, and a lower support area, such as a floor, said wall partition comprising:

partition means;

means for supporting said partition means between the upper support area and the lower support area;

locking means for selectively locking and unlocking at least one of sliding movement and swinging movement of said partition means;

said locking means comprising a singular unit being mounted on an external surface of said wall partition;

said locking means comprising:

first bolt means for selectively locking and unlocking the sliding movement of said partition means;

second bolt means, separate from said first bolt means, for selectively locking and unlocking the swinging movement of said partition means;

said first bolt means being selectively positionable between a first position and a second position different from said first position;

said first bolt means being configured to:

prevent sliding movement of said partition means when said first bolt means is in said first position;

permit sliding movement of said partition means when said first bolt means is in said second position;

said second bolt means being selectively positionable between a first position and a second position different from said first position;

said second bolt means being configured to:

prevent swinging movement of said partition means when said second bolt means is in said first position; and permit swinging movement of said partition means when said second bolt means is in said second position;

said locking means comprising a locking unit, said locking unit comprising an upper portion, a middle portion, and a lower portion, said middle portion being disposed between said upper portion and said lower portion;

said supporting means comprising first support means for slidably supporting said partition means and guiding sliding movement of said partition means;

said upper portion of said locking unit being disposed on said first support means;

said supporting means further comprising second support means for pivotably supporting said partition means and guiding a swinging movement of said partition means;

said middle portion of said locking unit being disposed on said second support means;

said lower portion of said locking unit being disposed on said partition means;

said first bolt means being disposed within a portion of each of said middle portion and said upper portion of said locking unit when in said first position;

said second bolt means being disposed within a portion of each of said lower portion and said middle portion of said locking unit when in said first position;

said locking unit comprising first hole means for accommodating therewithin said first bolt means, said first hole means extending through said locking unit from said lower portion of said locking unit, through said middle portion of said locking unit, to said upper portion of said locking unit;

said first hole means being configured to extend downwardly through said lower portion of said locking unit to an external portion of said locking unit;

first stop means for retaining said first bolt means within said first hole means, said locking unit comprising second hole means for accommodating therewithin said second bolt means, said second hole means extending through said locking unit from said lower portion of said locking unit to said middle portion of said locking unit;

said second hole means being configured to extend downwardly through said lower portion of said locking unit to an external portion of said locking unit;

said first hole means comprising an internal thread;

said first bolt means comprising an external thread for threadedly engaging with said internal thread of said first hole means;

said second hole means comprising an internal thread;

said second bolt means comprising an external thread for threadedly engaging with said internal thread of said second hole means;

said first hole means being configured for accommodating therewithin an adjustment tool for adjusting said first bolt means;

said second hole means being configured for accommodating therewithin an adjustment tool for adjusting said second bolt means;

said first bolt means being disposed completely separately from said upper portion of said locking unit when in said second position;

said second bolt means being disposed completely separately from said middle portion of said locking unit when in said second position;

said first support means comprising rail means for being disposed at the upper support area;

said second support means comprising intermediate frame means, said frame means being slidable with respect to said rail means;

hinge means being disposed on said intermediate frame means for guiding swinging movement of said partition means with respect to said intermediate frame means;

fastening means for:

fastening said upper portion of said locking unit to said rail means;

fastening said middle portion of said locking unit to said intermediate frame means; and fastening said lower portion of said locking unit to said partition means; said fastening means comprising six fasteners;

two each of said fasteners being provided for each of said upper portion, said middle portion and said lower portion of said locking unit;

said locking unit being selectively removable from said door by means of said fastening means;

said partition means comprising panel means being mounted on an external surface thereof;

said panel means being configured to cover a portion of said partition means;

said lower portion of said locking unit being fastened to said panel means of said partition means;

said internal thread of said first hole means being disposed in at least one of said upper portion and said middle portion of said locking unit;

said internal thread of said second hole means being disposed solely in said middle portion of said locking unit;

said first bolt means consisting of a single bolt;

said second bolt means consisting of a single bolt;

said second bolt means comprising an upper portion and a lower portion;

said external thread of said second bolt means being disposed solely in said upper portion of said second bolt means;

each of said upper portion and said lower portion of said second bolt means having a diameter, the diameter of said lower portion being generally less than that of said upper portion;

each of said first bolt means and said second bolt means comprising a head at an uppermost portion thereof;

said head of each of said first bolt means and said second bolt means being generally frustoconical and being configured to facilitate passage of each of said first bolt means and said second bolt means, respectively, through said first hole means and said second hole means;

each of said first bolt means and said second bolt means comprising a recessed socket portion at a lowermost end thereof;

said socket portion of each of said first bolt means and said second bolt means being configured for accommodating therewithin an adjusting tool;

said socket portion of each of said first bolt means and said second bolt means having a generally hexagonal cross-sectional shape;

adjustable stop means being disposed in said lower portion of said locking unit and extending towards said middle portion of said locking unit;

said adjustable stop means being configured to prevent tilting of said lower portion of said locking unit with respect to said upper portion of said locking unit;

said locking unit comprising one of a light alloy material and a plastic material;

roller means for extending between said partition means and said rail means, said roller means being rollingly disposed on said rail means to permit a sliding movement of said partition means with respect to said rail means;

said roller means comprising suspension means and roller cage means;

said roller cage means comprising a plurality of rollers and being rollingly disposed on said roller means;

said suspension means comprising at least one rod extending from said roller cage means to said partition means;

said hinge means comprising upper hinge means and floor lock means, said upper hinge means being disposed on said intermediate frame means and said floor lock means being disposed at a lower portion of said partition means;

said floor lock means being selectively positionable between a first, retracted position and a second, extended position;

said floor lock means, when in said second position, being configured for supplementing said upper hinge means to guide swinging movement of said partition means;

supplementary lock means disposed at a lower portion of said partition means, separately from said floor lock means;

said supplementary lock means being configured to lock said partition means in place; and a door closer extending between said partition means and said intermediate frame means.

* * * * *